US006216680B1

(12) United States Patent
Sanders

(10) Patent No.: US 6,216,680 B1
(45) Date of Patent: Apr. 17, 2001

(54) DEVICE AND METHOD FOR PROTECTING THE LOWER LIMB OF ARCHERY BOWS

(76) Inventor: Perry Sanders, R.R. 2 Box 419, Spencer, IN (US) 47460

( * ) Notice: Subject to any disclaimer, the term of this patent is extended or adjusted under 35 U.S.C. 154(b) by 0 days.

(21) Appl. No.: 09/521,068

(22) Filed: Mar. 8, 2000

(51) Int. Cl.[7] ..... F41B 5/14

(52) U.S. Cl. ..... 124/86

(58) Field of Search ..... 124/23.1, 25.6, 124/86

(56) References Cited

U.S. PATENT DOCUMENTS

| | | | | |
|---|---|---|---|---|
| 2,968,300 | * | 1/1961 | Allen | 124/23.1 |
| 4,979,488 | * | 12/1990 | Fenton et al. | 124/25.6 |
| 5,488,941 | * | 2/1996 | Springstead | 124/86 |
| 5,513,621 | * | 5/1996 | Vanskiver | 124/86 |
| 5,832,912 | * | 11/1998 | Olivarez | 124/86 |

* cited by examiner

*Primary Examiner*—John A. Ricci
(74) *Attorney, Agent, or Firm*—Welsh & Katz, Ltd.

(57) ABSTRACT

A device and method for protecting the lower limb of an archery bow is disclosed. The device comprises a sheet of flexible material of sufficient size to attach to the lower limb and fold under the lower limb and a fastening mechanism for attaching the device to the bow.

11 Claims, 3 Drawing Sheets

DEVICE AND METHOD FOR PROTECTING THE LOWER LIMB OF ARCHERY BOWS

FIELD OF THE INVENTION

This invention generally relates to archery equipment and, more particularly, to an accessory device used to protect archery bows from damage.

BACKGROUND OF THE INVENTION

The sport of archery is among the fastest growing in the world. From established disciplines such as target and filed archery to newer disciplines such as 3-D and ski archery, these diverse and varied disciplines are quickly making archery a favored sport among young and old alike.

To properly participate in archery, one must invest in quality equipment. Even the beginner is recommended to acquire quality equipment. Cheap, poorly constructed bows and arrows result in unreliability, inaccuracy, and the potential to cause injury. However, a good quality bow can easily cost upwards of several hundred dollars. Furthermore, proper maintenance of the bow is necessary to preserve its quality and keep it in good working order.

Thus, archers are constantly conscious of the possibility of damage to their expensive equipment. For example, when participating in 3-D archery, the archer typically walks long distances through a woodland course, shooting at life-size models of animals. While carrying a bow for such long distances is tiring, archers hesitate to set their bow on the ground for fear of causing serious damage to the bow's limbs, cams, strings, and pulleys. Even in the stationary discipline of target archery, archers need to be able to set their bows on the ground to rest without worrying about damaging their equipment. Thus, there is a clear need for a protective device and method that enables an archer to rest themselves while placing their bow on the ground safely and without damage.

SUMMARY OF THE INVENTION

Accordingly, the present invention provides a device and method for protecting the lower limb of an archery bow, enabling the archer to set the bow on the ground without damage. A device constructed in accordance with the present invention comprises a sheet of flexible material and a fastening mechanism for attaching the device to the bow. In one embodiment, the sheet of flexible material is of sufficient size so that it attaches to the lower limb with enough material left over to naturally fold underneath the lower limb when the bow is set to rest on the ground. Similarly, a method according to an aspect of the present invention comprises the steps of attaching a fastening mechanism to the lower limb of the archery bow, fastening a sheet of flexible material of sufficient size to a lower limb of an archery bow, and setting the archery bow on the ground whereby the sheet of flexible material naturally folds underneath the lower limb.

One of the primary objects of the present invention is to provide a protective device that allows archers to rest their bows on the ground while the bows are not being shot. Another object is to provide a device that allows archers to rest between shots or to rest while waiting to shoot by placing their bows on the ground without risk of damage to their bows. Still another object of the present invention is to provide a protective device that is easily attached and detached to and from an archery bow so that the protective device may be utilized on a wide variety of bows, both traditional and modern. Yet another object of the present invention is to provide a protective device that is simple to use thereby making it desirable for young archers as well as adults. A still further object of the present invention is to utilize a weather proof material so that the protective device is suitable for outdoor use.

Further objects, advantages, and features of the present invention will become apparent from the following detailed description of the preferred embodiments of the present invention when taken in conjunction with the accompanying drawings in which like reference numerals designate like elements through different views.

DETAILED DESCRIPTION OF THE PREFERRED EMBODIMENTS

Figure 1A:
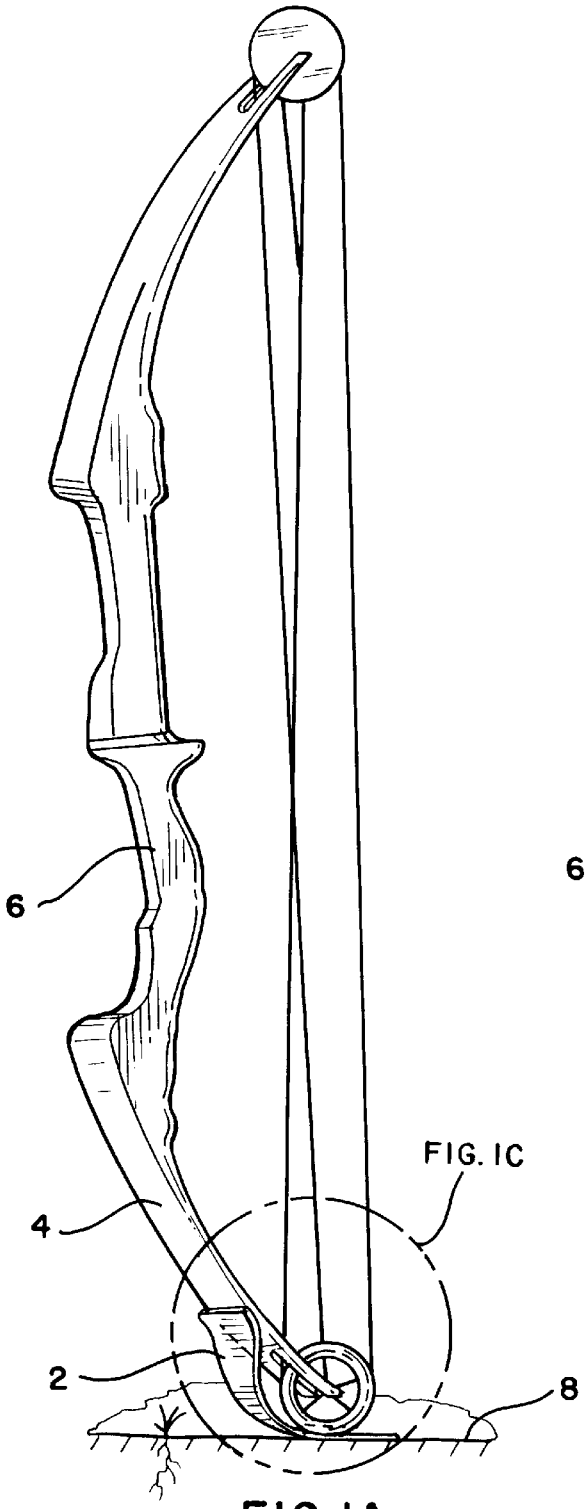
FIG. 1A shows an archery bow resting on the ground with a cam saver protective device attached to the lower limb of the bow.

Referring to the drawings, FIG. 1A depicts the overall view of an archery bow 6 resting on the ground 8 with the cam saver protective device 2 attached to the lower limb 4 of the bow. The cam saver protective device 2 is shown folded under the lower limb 4 of the bow 6 protecting the lower limb 4 from damage caused by the ground 8. FIG. 1C depicts an exploded view of the lower limb area 4 when the archery bow 6 is resting on the ground 8.

Figure 1B:
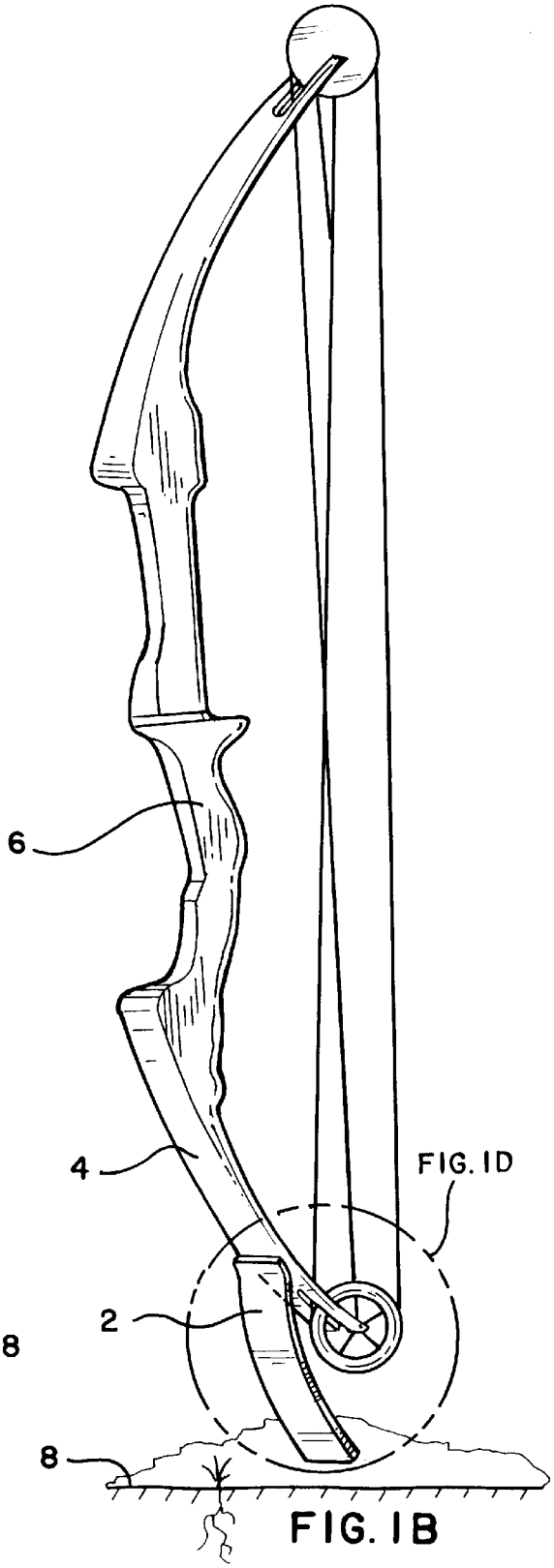
FIG. 1B shows an archery bow held off the ground with a cam saver protective device attached to the lower limb of the bow.
Figure 1C:
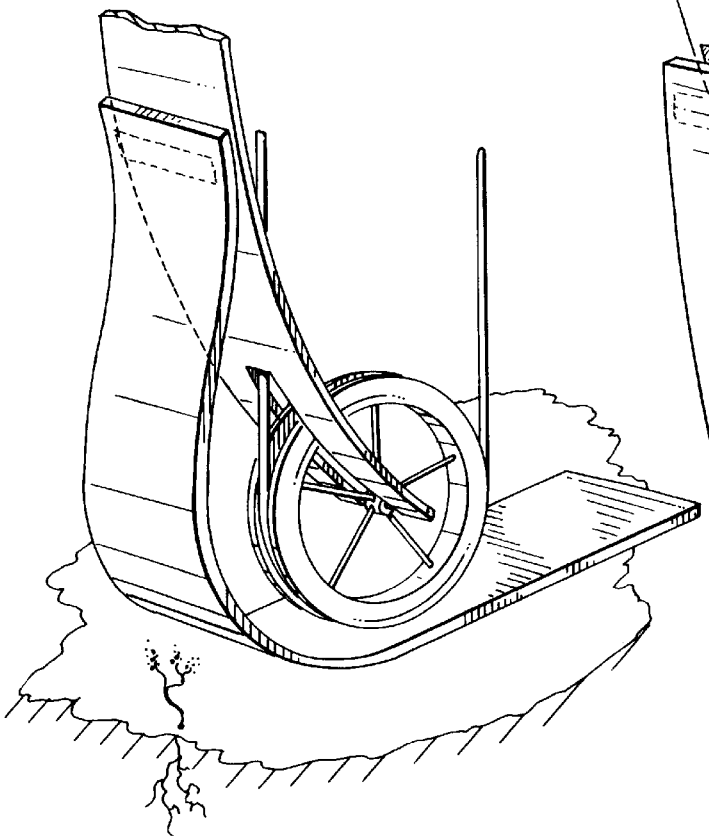
FIG. 1C depicts an exploded view of the lower limb area resting on the ground.
Figure 1D:
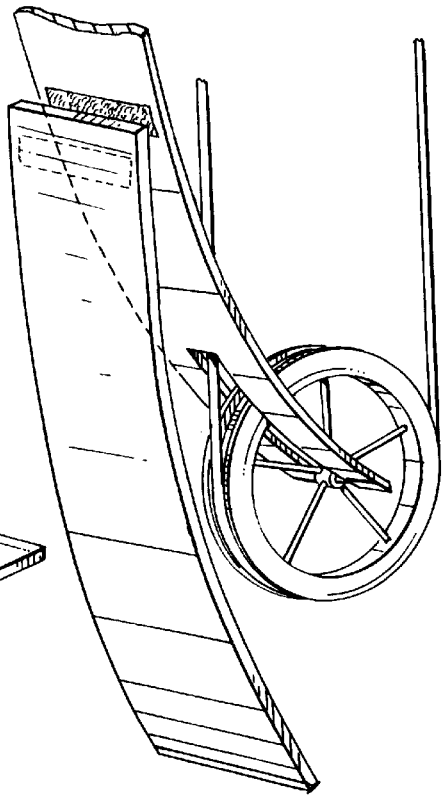
FIG. 1D depicts an exploded view of the lower limb area held off the ground.

In contrast, FIG. 1B depicts the overall view of an archery bow 6 held off the ground 8 with the cam saver protective device 2 attached to the lower limb of the bow. As seen, when the archery bow 6 is held off the ground 8, the cam saver protective device 2 hangs freely in a relaxed position. FIG. 1D depicts an exploded view of the lower limb area 4 when the archery bow 6 is held off the ground 8.

Figure 2:
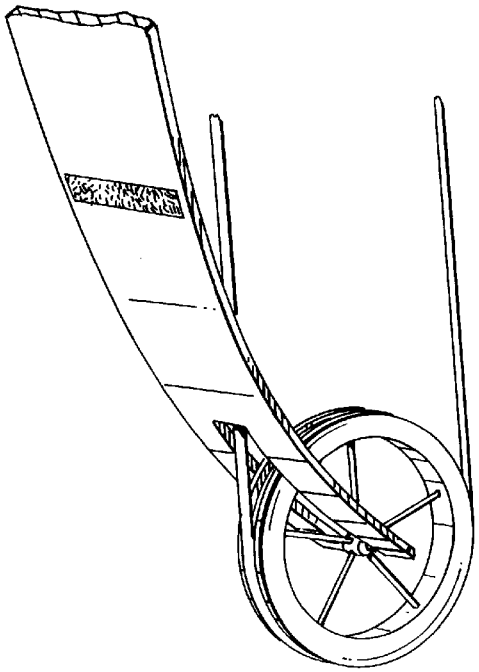
FIG. 2 depicts the lower limb of an archery bow with a hook part of VELCRO® attached to the lower limb of the bow.

In order to attach the cam saver protective device 2 to the archery bow 6, an exemplary embodiment of the cam saver protective device 2 utilizes hook and loop fasteners. FIG. 2 depicts a self adhesive hook fastener 10*b* attached to the lower limb 4 of the bow 6. The hook fastener 10*b* should be placed sufficiently low enough on the lower limb 4 that the cam saver protective device 2, when attached to the lower limb 4, hangs freely when the bow 6 is held off the ground but folds completely under the lower limb 4 when the bow 6 is resting on the ground.

Figure 3A:
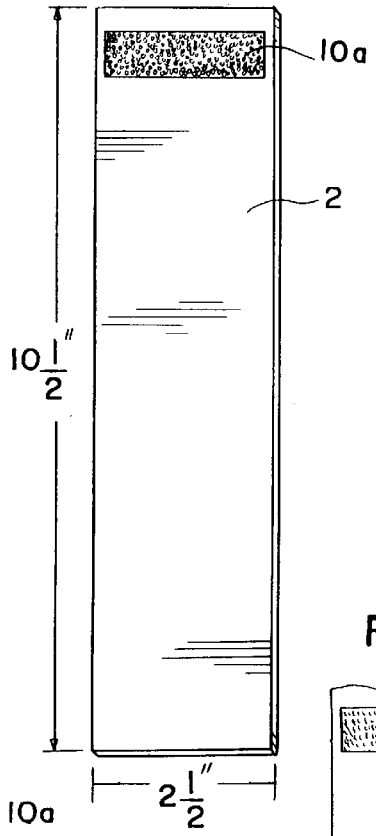
FIG. 3A shows a back view of an embodiment of the present invention with the fastener attached to the top of a cam saver.
Figure 3B:
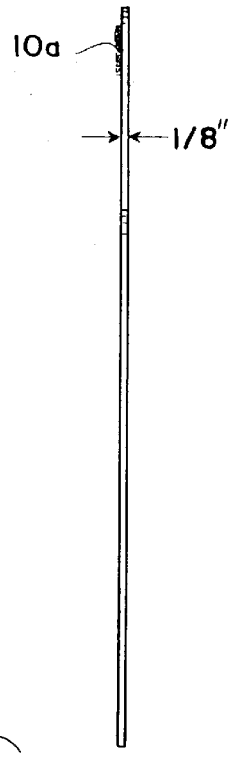
FIG. 3B depicts a side view of a cam saver according to an embodiment of the present invention.

As depicted in FIG. 3A, a loop fastener 10*a* is sewn to the top of the cam saver protective device in order to attach the cam saver protective device 2 to the lower limb 4. FIG. 3A shows that the cam saver protective device 2 is preferably a rectangular piece of material, preferably 2½" wide and 10½" long. A side view of an exemplary embodiment of the invention in FIG. 3B shows that the preferable thickness of the cam saver protective device 2 is ⅛".

Figure 4:
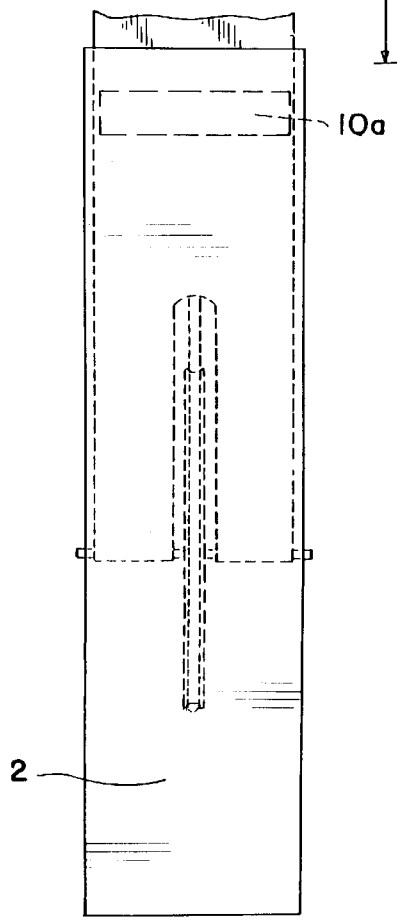
FIG. 4 depicts a side view of a cam saver according to an embodiment of the present invention.

FIG. 4 thus depicts the front view of the cam saver protective device 2 once it is attached by the hook and loop fasteners to the lower limb 4 of the archery bow 6. As seen, the cam saver protective device 2 hangs freely below the cam of the archery bow so that when the archer decides to rest the bow on the ground, the cam saver protective device will tuck neatly under the cam and provide a protective layer between the cam and the ground 8.

Figure 5:
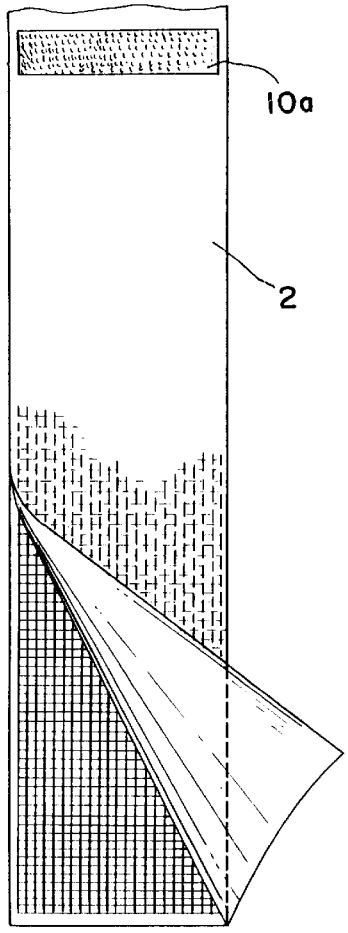
FIG. 5 depicts an exemplary embodiment of the present invention wherein the outer material of the cam saver is folded back.

In an exemplary embodiment of the cam saver protective device, the cam saver 2 is made of closed cell rubber with a stretchable fabric laminated to the outer surface, much like the material that diving wet suits are made from. Such material is recommended because it is soft and pliable, offering great protection for the archery bow 6 when it is being rested on the ground 8. Alternatively, cam saver 2 can be made from two pieces of canvas material sewn together with durable nylon thread. Because closed cell rubber is not adversely affected by weather or wet conditions, it is the ideal material to be used as a protective device for archery bows that are used both indoors and outdoors. Its non-slip character provides a steady cushion even on damp or slippery ground. Additionally, as depicted in FIG. 5, the cam saver 2 may be further strengthened and reinforced, according to an exemplary aspect of the present invention, wherein an inner layer consisting of a flexible plastic grid is sewn between the two outer layers of closed cell rubber. The closed cell rubber is durable and lightweight, making the cam saver protective device 2 nearly undetectable while being used.

Because the attaching mechanism of the cam saver protective device 2 is a hook and loop fastener, according to an exemplary aspect of the present invention, the cam saver protective device disclosed herein can be used with multiple bows as well as different types of bows. As long as a self adhesive hook fastener 10*b* is attached to the lower limb of a particular bow, the cam saver protective device 2 can be used to protect its lower limb. As readily apparent to those of ordinary skill in the relevant art, types of detachable coupling devices other than hook and loop fasteners may be utilized such as, for example, snap fasteners.

To install the cam saver protective device 2 on an archery bow 6, one must first apply a self adhesive hook fastener 10*b* to the outside edge of the lower limb 4 of the archery bow 6. Generally, the hook fastener 10*b* should be placed approximately 6" from the top of the limb or pulley. This permits a sufficient portion of the cam saver protective device 2 to fold under the limb or pulley when it is set down on the ground. The loop fastener 10*a* on the cam saver protective device 2 is lined up with the hook fastener 10*b* on the lower limb 4 and the two fasteners are pressed together to attach the cam saver protective device 2 to the lower limb 4. To remove the cam saver protective device 2 from the bow 6, one grasps the invention 2 near the loop fastener 10*a* and gently pulls it away from the lower limb 4 of the bow 6.

To use the cam saver protective device 2, the archer simply lowers the bow 6 to the ground 8. As the cam saver protective device 2 comes in contact with the ground 8, it will naturally fold under the lower limb 4 of the bow 6 providing protection from the ground 8. After the archer has rested or is ready to shoot, she simply raises the bow 6 off the ground 8. As the bow 6 is lifted off the ground 8 the cam saver protective device 2 will hang freely from the lower limb 4 in a relaxed position without interfering with the bow's 6 normal functions.

While a detailed description of the preferred embodiment of the present invention has been given, it should be understood that the implementation of other variations and modifications of the invention and its various aspects will be apparent to one skilled in the art. It is to be understood that no limitation with respect to the specific embodiments illustrated is intended or should be inferred. The disclosure is intended to cover the present invention, any and all modifications, variations, or equivalents that fall within the true spirit and scope of the basic underlying principles disclosed and claimed herein.

What is claimed is:

1. A device for protecting a lower limb of an archery bow comprising:

a sheet of flexible material of sufficient size to attach to the lower limb and fold under the lower limb;

a fastening mechanism for attaching the device to the bow; and wherein the flexible material comprises a material selected from a group consisting of closed cell rubber.

2. A device for protecting a lower limb of an archery bow comprising:

a sheet of flexible material of sufficient size to attach to the lower limb and fold under the lower limb;

a fastening mechanism for attaching the device to the bow; and wherein the flexible material comprises a material selected from a group consisting of two pieces of canvas material sewn together with durable nylon thread, and a flexible plastic grid sewn in between the two pieces of canvas material.

3. A device for protecting a lower limb of an archery bow comprising:

a sheet of flexible material of sufficient size to attach to the lower limb and fold under the lower limb;

a fastening mechanism for attaching the device to the bow; and wherein the sheet of flexible material is of rectangular shape with a length of about 10½", a width of about 2½", and a thickness of about ⅛".

4. A device for protecting a lower limb of an archery bow comprising:

a sheet of flexible material of sufficient size to attach to the lower limb and fold under the lower limb;

a fastening mechanism for attaching the device to the bow; and wherein the fastening mechanism comprises a loop fastener and a self adhesive hook fastener.

5. The device of claim 4 wherein the loop fastener is sewn to the top of the sheet of flexible material.

6. The device of claim 4 wherein the self adhesive hook fastener is attached to the lower limb of the archer bow.

7. A device for protecting a lower limb of an archery bow comprising:

a sheet of flexible material of sufficient size to attach to the lower limb and fold under the lower limb;

a fastening mechanism for attaching the device to the bow; and wherein the sheet of flexible material freely hangs when the bow is held off the ground.

8. A method for protecting a lower limb of an archery bow comprising:

attaching a fastening mechanism to the lower limb;

fastening a sheet of flexible material of sufficient size to attach to the lower limb and fold under the lower limb;

setting the archery bow on the ground whereby the sheet of flexible material naturally folds underneath the lower limb; and wherein the fastening mechanism comprises a self adhesive hook fastener and a loop fastener.

9. The method of claim 8 wherein the attaching step further comprises the steps of applying the self adhesive hook fastener to the lower limb and sewing the loop fastener to the top of the sheet of flexible material.

10. The method of claim 8 wherein the fastening step further comprises the step of lining up the hook fastener with the loop fastener and pressing together the hook fastener and the loop fastener.

11. A method for protecting a lower limb of an archery bow comprising:

attaching a fastening mechanism to the lower limb;

fastening a sheet of flexible material of sufficient size to attach to the lower limb and fold under the lower limb;

setting the archery bow on the ground whereby the sheet of flexible material naturally folds underneath the lower limb; and wherein the sheet of flexible material is fastened approximately 6" from the top of the lower limb.

* * * * *